US006725840B1

(12) United States Patent
Mahr et al.

(10) Patent No.: US 6,725,840 B1
(45) Date of Patent: Apr. 27, 2004

(54) FUEL INJECTION DEVICE

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/830,013

(22) PCT Filed: Aug. 12, 2000

(86) PCT No.: PCT/DE00/02735

§ 371 (c)(1),
(2), (4) Date: Jul. 27, 2001

(87) PCT Pub. No.: WO01/14712

PCT Pub. Date: Mar. 1, 2001

(30) Foreign Application Priority Data

Aug. 20, 1999 (DE) ..... 199 39 419

(51) Int. Cl.[7] ..... F02M 41/00
(52) U.S. Cl. ..... 123/467; 123/496
(58) Field of Search ..... 123/467, 496, 123/447, 514, 504, 500, 501

(56) References Cited

U.S. PATENT DOCUMENTS

| | | | | | |
|---|---|---|---|---|---|
| 4,640,252 | A | * | 2/1987 | Nakamura et al. | 123/446 |
| 4,798,186 | A | * | 1/1989 | Ganser | 123/467 |
| 5,456,233 | A | * | 10/1995 | Felhofer | 123/447 |
| 5,505,384 | A | | 4/1996 | Camplin | |
| 5,517,972 | A | | 5/1996 | Stockner | |
| 5,622,152 | A | * | 4/1997 | Ishida | 123/446 |
| 5,626,121 | A | * | 5/1997 | Kushida et al. | 123/514 |
| 5,642,716 | A | * | 7/1997 | Ricco | 123/456 |
| 5,662,087 | A | | 9/1997 | McCandless | |
| 5,671,715 | A | * | 9/1997 | Tsuzuki | 123/467 |
| 5,711,277 | A | * | 1/1998 | Fuseya | 123/496 |
| 5,732,679 | A | * | 3/1998 | Takahasi et al. | 123/467 |
| 5,878,718 | A | * | 3/1999 | Rembold et al. | 123/456 |
| 5,890,471 | A | * | 4/1999 | Nishimura | 123/496 |
| 6,092,509 | A | * | 7/2000 | Tanabe et al. | 123/447 |
| 6,168,132 | B1 | * | 1/2001 | Frank et al. | 251/33 |
| 6,189,509 | B1 | * | 2/2001 | Froment | 123/467 |
| 6,230,688 | B1 | * | 5/2001 | Faix et al. | 123/495 |
| 6,336,444 | B1 | * | 1/2002 | Suder | 123/496 |

FOREIGN PATENT DOCUMENTS

| | | |
|---|---|---|
| AT | 002 961 U2 | 7/1999 |
| DE | 197 26 604 A1 | 1/1998 |
| GB | 2 347 179 A | 8/2000 |

* cited by examiner

*Primary Examiner*—Carl S. Miller
(74) *Attorney, Agent, or Firm*—Ronald E. Greigg

(57) ABSTRACT

A fuel injection system has one or more unit fuel injectors or pump-line-nozzle units, corresponding in number to the cylinders, for compressing the fuel. The fuel injection system includes means for generating two different injection pressures during the injection and at least one valve for controlling the injection with a cross sectional control. The fuel injection with the aid of the unit fuel injector or a pump-line-nozzle unit can be achieved over a wide rpm range with great precision.

3 Claims, 2 Drawing Sheets

FUEL INJECTION DEVICE

CROSS-REFERENCE TO RELATED APPLICATIONS

This application is a 35 USC 371 application of PCT/DE 00/02735 filed on Aug. 12, 2000.

BACKGROUND OF THE INVENTION

1. Field of the Invention

The invention relates to a fuel injection system and more particularly to an improved fuel injection system which produces two different injection pressures.

2. Description of the Prior Art

For the sake of better understanding of the description and claims, several terms will now be explained. The fuel injection system according to the invention can be embodied as either stroke-controlled or pressure-controlled. Within the scope of the invention, the term stroke-controlled fuel injection system will be understood to mean that the opening and closing of the injection opening is effected with the aid of a displaceable valve member as a result of the hydraulic cooperation of the fuel pressures in a nozzle chamber and in a control chamber. A pressure reduction inside the control chamber causes a stroke of the valve member. Alternatively, the deflection of the valve member can be effected by a final control element (or actuator). In a pressure-controlled fuel injection system according to the invention, the valve member is moved counter to the action of a closing force (spring) by the fuel pressure prevailing in the nozzle chamber of an injector, so that the injection opening is uncovered for an injection of the fuel from the nozzle chamber into the cylinder. The pressure at which fuel emerges from the nozzle chamber into a cylinder is called the injection pressure, while the term system pressure is understood to be the pressure at which fuel is available or is stored inside the fuel injection system. Fuel metering means delivering fuel to the nozzle chamber by means of a metering valve. In combined fuel metering, a common valve is used to meter various injection pressures. In the pump-nozzle unit (PDE), also called a unit fuel injector, the injection pump and the injector form a unit. One such unit per cylinder is built into the cylinder head and driven either directly via a tappet or indirectly via tilting levers by the engine camshaft. The pump-line-nozzle system (PLD) operates by the same method. In this case, a high-pressure line leads to the nozzle chamber or nozzle holder.

A unit fuel injector is known for instance from German Patent Disclosure DE 195 175 78 A1. In this fuel injection system, the system pressure is generated via a piston that can be acted upon by pressure and whose motion is controlled by a cam drive. A variable fuel injection of different quantities for the sake of preinjection, main injection and postinjection is only limitedly feasible by means of this kind of fuel injection system.

SUMMARY OF THE INVENTION

To achieve fuel injection with the aid of a unit fuel injector or a pump-line-nozzle unit over a wide rpm range with great precision, a fuel injection system according to the invention is proposed. Refinements make it possible to remove pollutant exchange and more-flexible preinjection and optionally a postinjection by means of a unit fuel injector or a pump- line-nozzle system. If a valve with a cross sectional control, for instance by means of a piezoelectric actuator, is used for the fuel metering, then improved metering of the injected fuel quantity can be achieved. This creates a good minimum-quantity capability in the preinjection. The development of the injection course in the main injection can be varied in a targeted way. Each unit fuel injector or pump-line-nozzle unit can contain a pressure storage chamber, which can be decoupled from the unit and filled with fuel during the pumping stroke of the compression device. By means of the pressure storage chamber, control of the injection pressure can be done relatively independently of the engine rpm. The time between the triggering of the pressure buildup and the injection can be selected freely within wide ranges. The time of the onset of the pressure buildup determines the pressure level attained.

BRIEF DESCRIPTION OF THE DRAWINGS

The foregoing advantages and features of the invention will be apparent from the detailed description contained herein below, taken with the drawings in which.

DESCRIPTION OF THE PREFERRED EMBODIMENTS

Figure 1:
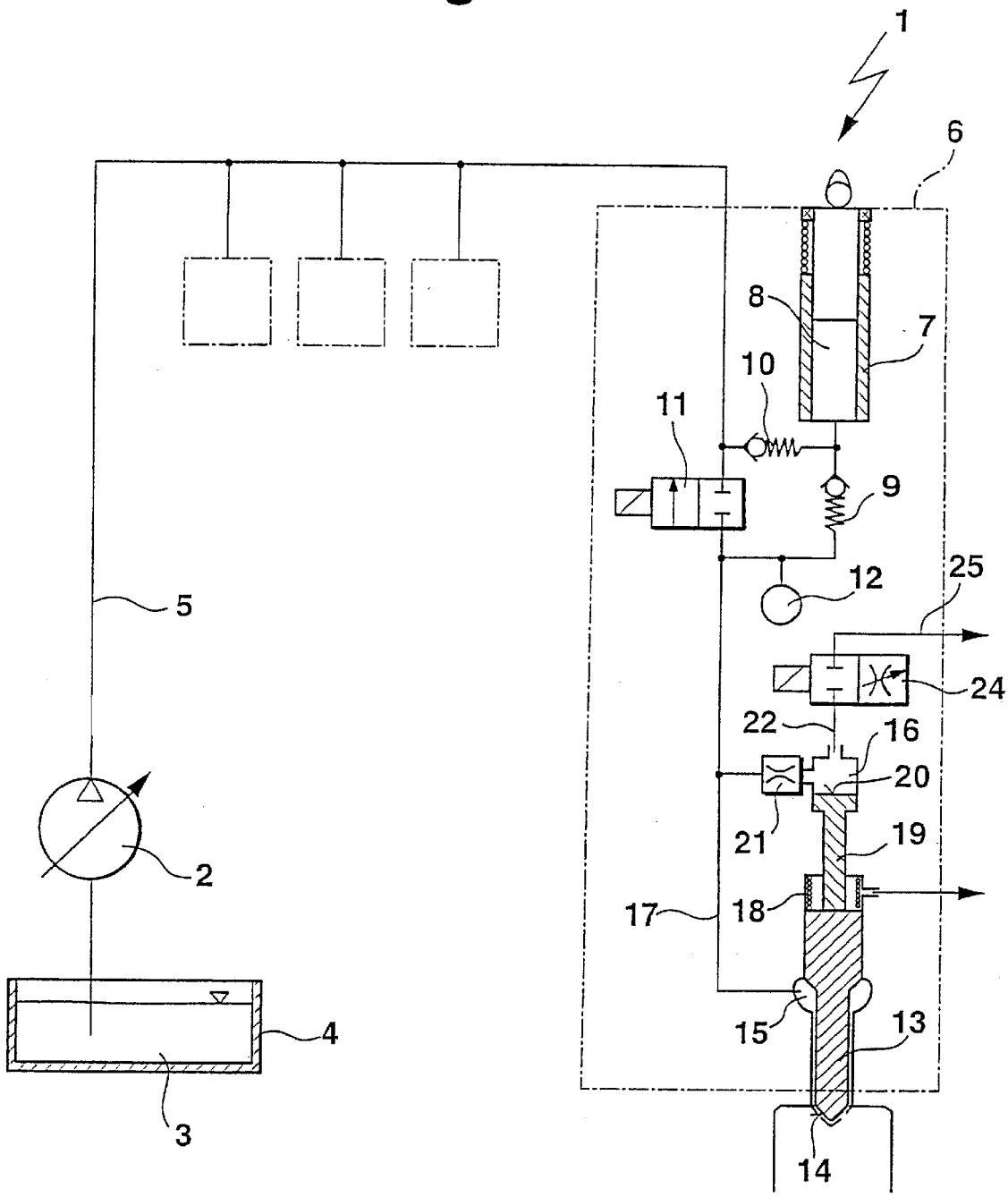
FIG. 1, is a schematic view, partially in section of a stroke-controlled fuel injection system.

In the first exemplary embodiment, shown in FIG. 1, of a stroke-controlled fuel injection system 1, a prefeed pump 2 pumps fuel 3 from a tank 4 via a feed line 5 to a plurality of unit fuel injectors 6 (injection devices), corresponding in number to the number of individual cylinders of an internal combustion engine to be supplied and protruding into the combustion chamber of the engine. In the drawing, only one of the unit fuel injectors 6 is shown.

Each unit fuel injector 6 is composed of a fuel compressing device 7 and means for injection. Per engine cylinder, one unit fuel injector 6 is built into a cylinder head. The compression device 7 is driven either directly via a tappet or indirectly via tilting levers by an engine camshaft. Electronic regulating devices make it possible to exert targeted influence on the quantity of injected fuel (injection course) in a known manner.

The fuel compressing device 7 can compress fuel in a compression chamber 8. Check valves 9 and 10 and a 2/2-way valve 11 prevent the return flow of fuel in the direction of the feed pump 2 to the low-pressure region. The fuel compressing device 7 can be part of a unit fuel injector (PDE) known per se or of a pump-line-nozzle unit (PLD). The fuel compressing device 7 serves to generate an injection pressure. The pressure buildup is achieved with the aid of the 2/2-way valve 11.

During the pumping stroke of the fuel compressing device 7, the pressure storage chamber 12 can be filled with fuel and decoupled from the pressure generation region via the check valves 9 and 10.

The injection is effected via fuel metering with the aid of a pistonlike valve member 13, which is axially displaceable in a guide bore and has a conical valve sealing face 14 on one end, with which face it cooperates with a valve seat face on the injector housing of the injector unit 6. Injection openings are provided on the valve seat face of the injector housing. A nozzle chamber 15 and a control chamber 16 are formed. Inside the nozzle chamber 15, a pressure face pointing in the opening direction of the valve member 13 is exposed to the pressure prevailing there, which is delivered to the nozzle chamber 15 via a pressure line 17. The valve member 13 is furthermore engaged coaxially to a compression spring 18 by a tappet 19, which with its face end 20 remote from the valve sealing face 14 defines the control chamber 16. From the direction of the fuel pressure connection, the control chamber 16 has an inlet with a throttle 21 and an outlet to a pressure relief line 22, which is controlled by a valve unit 24.

The nozzle chamber 15 continues across an annular gap between the valve member 13 and the guide bore, up to the valve seat face of the injector housing. The tappet 19 is urged by pressure in the closing direction, via the pressure in the control chamber 16. By throttling of the valve cross section inside the valve unit 24, an injection pressure that is variable during injection and thus a shaping of the course of injection can be achieved by means of a cross sectional control, in which the pressure in the control chamber 16 is varied and thus throttling of the injection pressure is achieved at the valve sealing face 14 via the valve member 13. To achieve a continuous cross sectional control, both piezoelectric actuators and fast-acting magnet actuators are conceivable. By providing multi-stage valves, instead of a continuous shaping of the injection pressure, a plurality of different injection pressure levels can be generated during injection by means of various throttle positions. Analogously, throttling at the valve cross section of the valve 11 would also be conceivable for forming the course of injection, as shown in the second embodiment illustrated in FIG. 2.

The valve unit 24 is actuated by an electromagnet or piezoelectric actuator to open or close or switch over. The actuator is triggered by a control unit, which is capable of monitoring and processing various operating parameters (engine rpm, and so forth) of the engine to be supplied.

Fuel at a system pressure constantly fills the nozzle chamber 15 and the control chamber 16. Upon actuation of the valve unit 24, the pressure in the control chamber 16 can be lowered, so that as a consequence, the pressure in the nozzle chamber 15 exerted in the opening direction on the valve member 13 predominates over the pressure acting in the closing direction on the valve member 13. The valve sealing face 14 lifts from the valve seat face, and fuel is injected. The pressure relief process for the control chamber 16 and thus the control of the stroke of the valve member 13 can be varied by way of the dimensioning of the first throttle 21 and second throttle in valve unit 24 as well as additional throttling in the valve seat.

The end of injection is initiated by re-actuating (closing) the valve unit 24; this decouples the control chamber 16 from a leakage line 25 again, so that in the control chamber 16, a pressure builds up again that can move the valve member 13 in the closing direction.

The pressure drop during the main injection is compensated for by the fact that the fuel compressing device 7 further fills the pressure storage chamber 12. The size of the pressure storage chamber 12 is preferably selected such that the preinjection and postinjection can be performed by means of pumping of fuel that is done from the pressure storage chamber 12. The compression chamber 8 of the fuel compressing device 7 can be re-filled independently of the region of the fuel injection. The pressure buildup in the region of the fuel metering is determined by actuation of the 2/2-way valve 11. For limiting the maximum pressure within the fuel injection system, a pressure limiting valve (not shown in the exemplary embodiment) can be used in the region of the pressure storage chamber.

Figure 2:
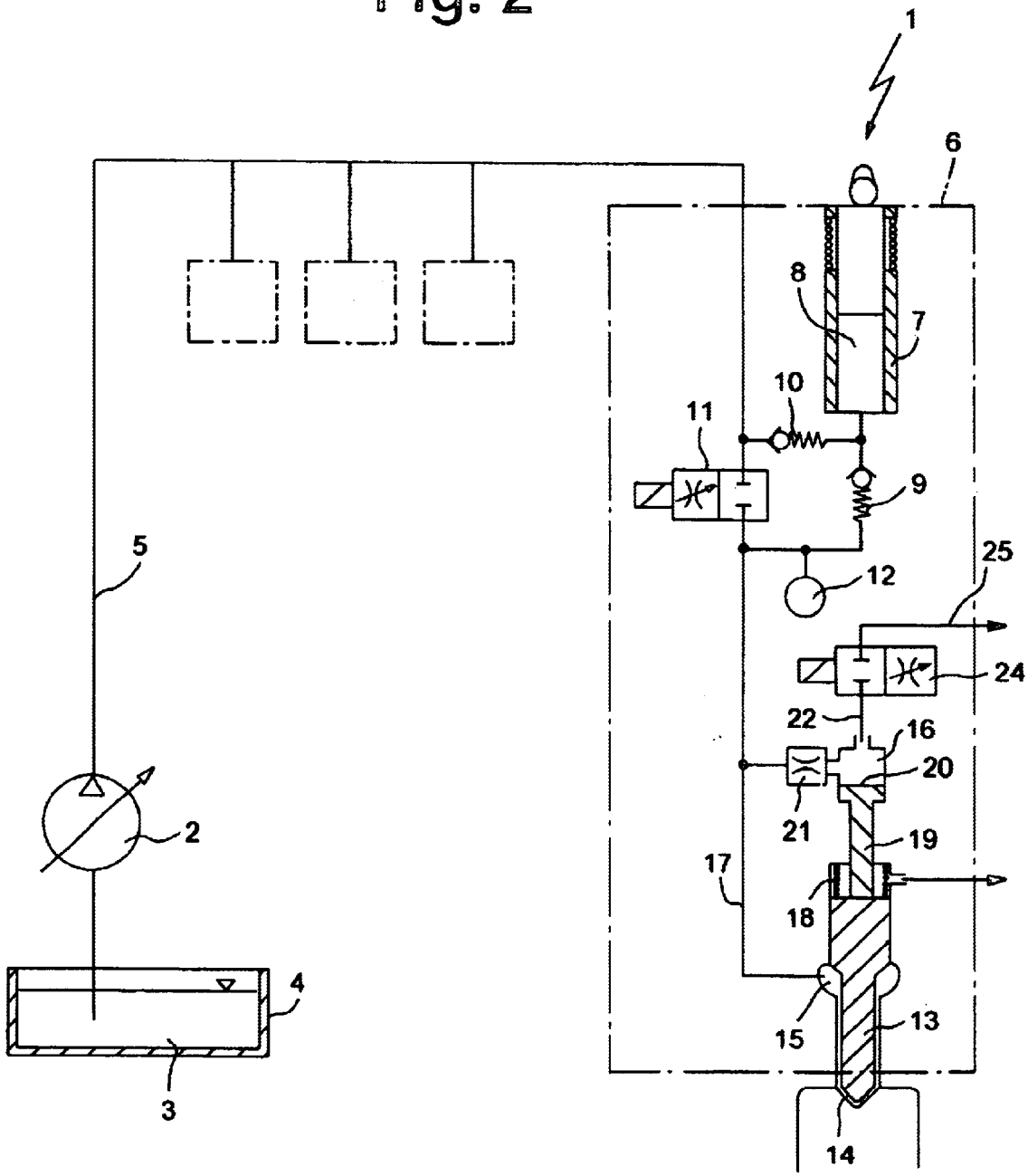
FIG. 2, is a view similar to FIG. 1 showing a second embodiment of a stroke-controlled fuel injection system.

The first exemplary embodiment of a fuel injection system 1 and the second exemplary embodiment of a fuel injection system 31 in FIG. 2 have in common the fact that an advantageous unit fuel injector 6 or 36 is combined with a local pressure storage chamber and a cross sectional control of the fuel-metering valve unit.

The first exemplary embodiment of a fuel injection system 1 and the second exemplary embodiment of a fuel injection system 1 in FIG. 2 have in common the fact that an advantageous unit fuel injector 6 is combined with a local pressure storage chamber and a cross sectional control of the fuel-metering valve unit.

The local pressure storage chamber 12 is utilized to store the pressure, to make a flexible instant of injection possible for a preinjection or postinjection outside the cam stroke of the unit fuel injector 6. The pressure storage chamber 12 enables the control of the injection pressure independently of the rpm of the internal combustion engine. This is done by regulating the time between the triggering of the pressure buildup and the triggering of the injection. The time for filling the pressure storage chamber 12 determines the pressure level attained. Separate valve units are used for the buildup of the injection pressure and for the control of the injection.

The foregoing relates to preferred exemplary embodiments of the invention, it being understood that other variants and embodiments thereof are possible within the spirit and scope of the invention, the latter being defined by the appended claims.

We claim:

1. A fuel injection system (1) comprising one or more unit fuel injectors (6) or pump-line-nozzle units, corresponding in number to the cylinders, for compressing the fuel, said fuel injection system (1) including a fuel injector (6) having a nozzle chamber (15) and a control chamber (16), a high pressure delivering means comprising a compression device (7) for compressing fuel in a compression chamber (8), a pressure line (17) connecting said fuel compressing device (7) with said nozzle chamber (15), said pressure line including a pressure storage chamber (12), which can be decoupled from the fuel compressing device (7), said pressure storage chamber (12) communicating with said compression chamber (8), said nozzle chamber (15) and said control chamber (16) and a 2/2-way valve (11) for lowering the pressure in the storage chamber (12) and having means for throttling the valve cross section inside the valve, said valve (11) being positioned in said pressure line (17) between said fuel compressing device (7) and said nozzle chamber (15).

2. The fuel injection system of claim 1, wherein the fuel injection system (1) includes means for stroke-controlled performance of the fuel injection.

3. The fuel injection system of claim 1, wherein the fuel injection system (1) includes means for pressure-controlled performance of the fuel injection.

* * * * *